United States Patent [19]

Dahmen

[11] Patent Number: 4,821,664

[45] Date of Patent: Apr. 18, 1989

[54] FURLING STAY COVER

[75] Inventor: Joseph E. Dahmen, Concord, Mass.

[73] Assignee: Cruising Design, Inc., Peabody, Mass.

[21] Appl. No.: 62,555

[22] Filed: Jun. 12, 1987

[51] Int. Cl.[4] ..... B63H 9/08

[52] U.S. Cl. ..... 114/107; 114/39.1

[58] Field of Search ..... 114/39.1, 102, 103, 114/104, 105, 106, 107, 108, 109, 111

[56] References Cited

U.S. PATENT DOCUMENTS

| | | | |
|---|---|---|---|
| 2,107,303 | 2/1938 | Ljungstrom | 114/104 |
| 3,611,969 | 10/1971 | Hood | 114/104 |
| 3,789,790 | 2/1974 | Crall | 114/106 |
| 3,800,728 | 4/1974 | Dowling | 114/104 |
| 3,802,373 | 4/1974 | Lagerquist | 114/102 |
| 3,851,609 | 12/1974 | Stearn | 114/104 |
| 3,980,036 | 9/1976 | Crall | 114/106 |
| 4,248,281 | 2/1981 | Hood | 114/106 |
| 4,266,495 | 5/1981 | Hood | 114/108 |
| 4,267,791 | 5/1981 | Ingouf | 114/106 |
| 4,619,216 | 10/1986 | Crear et al. | 114/103 |

*Primary Examiner*—Joseph F. Peters, Jr.

*Assistant Examiner*—Edwin L. Swinehart

*Attorney, Agent, or Firm*—Hamilton, Brook, Smith & Reynolds

[57] ABSTRACT

A forestay cover has a central tunnel for housing a forestay and two symmetrical side grooves on opposite longitudinal sides. One side groove engagably retains a staysail. The second side groove employs a hoisting handle attached to a halyard of the staysail. A cap on top of the cover provides a curved pathway for the halyard from the one side groove around one side of the central tunnel and into the second side groove. The bottom of the cover is releasably attached to a swivel which rotates the cover about the forestay and thereby furls the staysail. The cover is elastic enough to twist during furling without reaching its elastic limit. The cover is also flexible enough to bend to a radius of less than about one half its length. The swivel rotates about a bearing which is prevented from rotating by a u-shaped bracket. The legs of the u-shaped bracket are secured to the bearing and the curved portion of the u-shaped bracket is linked to a bow fixture, such as a toggle strap.

42 Claims, 6 Drawing Sheets

FURLING STAY COVER

BACKGROUND OF THE INVENTION

Sailing has become a popular sport both for competition and leisure. Along with a growth in interest in the sport is an increase in demand for efficient accessories to enhance the sport. One sort of such accessory developed a few years ago, enables a second stay sail to be hoisted and set before a previously hoisted and set staysail is lowered. One design of that sort of accessory is disclosed in U.S. Pat. No. 3,851,609 as a two grooved stay. That two grooved stay comprises a metal material and actually replaces a forestay. The stay may also be rotated to furl a single sail.

Further development, introduced another design which is disclosed in U.S. Pat. No. 4,619,216 as a snap-on attachment to the stay with fore and aft channels for staysails. This attachment comprises a flexible material and is unable to furl the staysail.

SUMMARY OF THE INVENTION

In the past it was thought that very rigid stay devices were required in order to allow furling. However, the present invention provides a stay device which is stiff enough to allow it to furl, yet is elastic and flexible enough to enable, without damage, twisting during furling and bending of the device for ease in stepping and unstepping the mast for transportation or storage. The degree of torsional stiffness, T, required of the device is calculated from the formula $$T = (\text{rolling radius}) \times (\text{sail area}) \times (\text{windspeed})^2 \times 0.00431.$$

A preferred embodiment comprises an elongated member which acts as a cover for the stay. The elongated member has a centrally positioned tunnel in which the stay is retained. Two side grooves lie along opposite sides of the elongated member. The major axes of the side grooves and tunnel are parallel to the longitudinal axis of the elongated member. The first side groove of the elongated member receives and engagably retains a luff edge of a staysail. The second side groove receives and retains a halyard which has one end connected to the staysail. The bottom end of the elongated member is releasably held by a spool/throat assembly, or other swivel means, which rotates the elongated member about the stay to furl the staysail. The elongated member is stiff enough that during furling under typical wind loads, the elongated member twists no more than one or two turns, but is flexible and elastic enough to be able to twist at least five times without reaching its elastic limit.

Further, when the stay is slackened or removed, the elongated member is flexible and elastic enough to bend along its length, without being permanently damaged, to a radius of less than half its length. Preferrably, the elongated member may bend to form a closed loop.

The elongated member preferably comprises an extruded, polymeric, thermoplastic with a tensile modulus between about $4\times10^5$ and $5\times10^5$ pounds/square inch and a shear modulus between about 50,000 and 200,000 inch-pounds/radian, such as rigid PVC.

In accordance with another aspect of the present invention, a hoisting eye protrudes from and slides in the second side groove from the top end of the elongated member toward the bottom end. The leading or free end of the halyard is attached to the hoisting eye. A temporary hoisting line is attached to the eye and is removed after the sail is hoisted. The eye can then be cross-pinned to the elongated member or can be tied off with a short piece of line to a cleat on the spool/throat assembly. The sliding of the hoisting eye in a direction toward the bottom end of the elongated member causes the halyard to pull the staysail up through the first side groove. The halyard thus travels upward along the first side groove, across the top end or the elongated member, and downward through the second side groove.

In accordance with another aspect of the present invention, a cap fits over the top end of the elongated member. The cap has a curved pathway which guides the halyard from just outside the first side groove, around one side of the tunnel, and into the second side groove. The pathway does not intersect the tunnel. Each end of the pathway forms an opening through the cap. One opening is through the side of the cap which lies along the first side groove. The other opening is downward into the second side groove. A cap using conventional sheaves or a sheave may also be used.

In accordance with another aspect of the present invention, the spool/throat assembly includes a non-rotatable bearing, a spool, a line wound about the spool and a housing for the spool. The bottom end of the stay is secured directly or indirectly to the bearing. The spool has an upper throat end which removeably receives and retains the bottom end of the elongated member. The lower end of the spool rotatably attaches to the bearing positioned within the spool housing. When the line is pulled through an aperture in the spool housing, the spool rotates about the bearing and rotates the elongated member about the stay which in turn furls the staysail. Other swivel means in place of the spool/throat assembly are suitable.

In a preferred design of the spool/throat assembly, a u-shaped bracket has its two legs secured to the bearing and its curved portion passing between the legs of a toggle strap which is attached to the forestay and pinned to the stemhead fitting of the boat. The u-shaped bracket prevents the bearing and housing from rotating about the forestay.

In another embodiment of the invention, the elongated member is a succession of elongated pieces joined end to end. Adjacent ends are preferrably joined together by a pair of plates. One plate of the pair is glued to one side of the elongated member between the two grooves and bridges the ends of the adjacent pieces. The second plate of the pair is glued to an opposite side of the elongated member between the two grooves and bridges the ends of the adjacent pieces.

BRIEF DESCRIPTION OF THE DRAWINGS

The foregoing and other objects, features and advantages of the invention will be apparent from the following more particular description of a preferred embodiment of the invention, as illustrated in the accompanying drawings. The drawings are not necessarily to scale, emphasis instead being placed upon illustrating the principles of the invention.

DESCRIPTION OF THE PREFERRED EMBODIMENT

Figure 1:
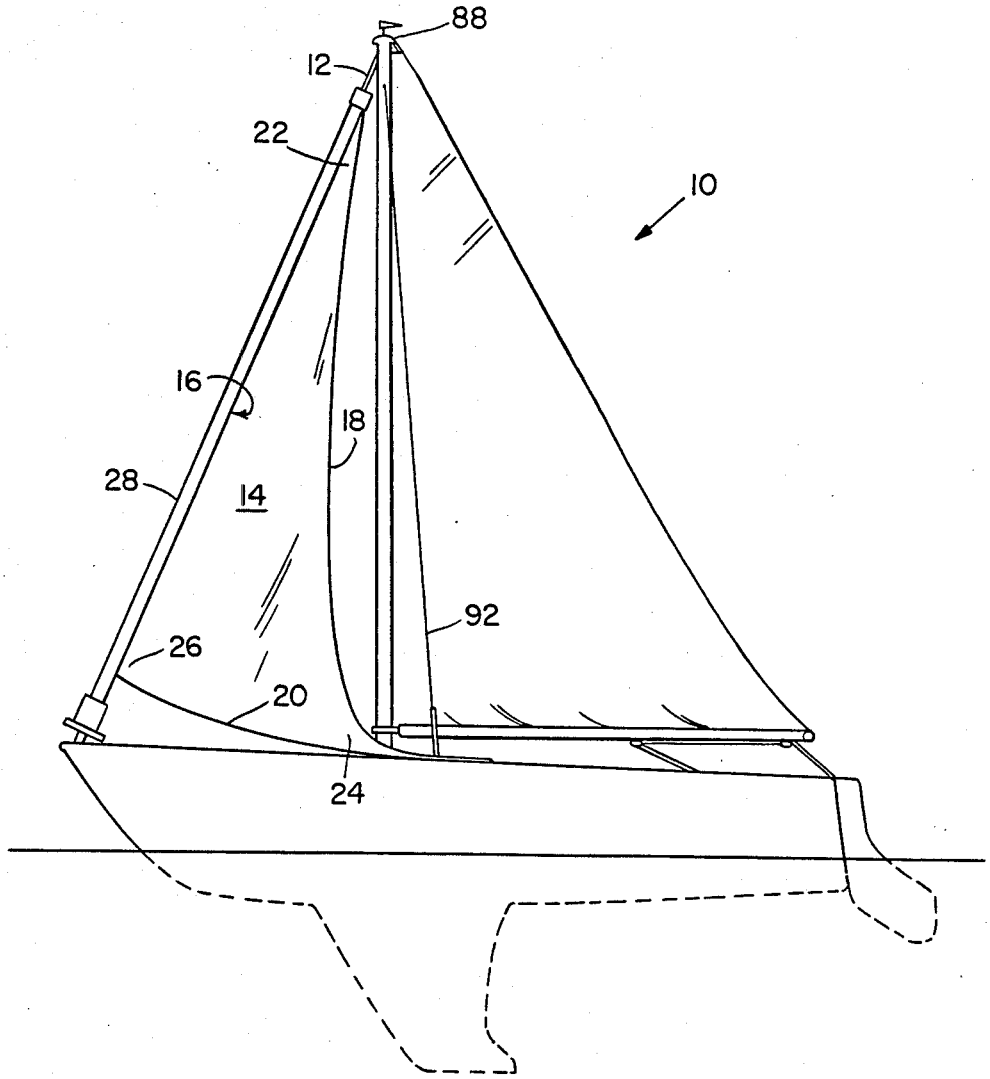
FIG. 1 is a side view of a sailboat employing the present invention.

Provided in FIG. 1 is an illustration of a sailboat employing the present invention. Sailboat 10 has a mast 88 supported by stays. Side stays 92 have a bottom end attached to chain plates on sides of the boat, and a forestay 12 supports a mast 88 from a stemhead fitting on the bow of the boat. Attached to forestay 12 is a staysail or a jib 14. The jib 14 is generally triangular in shape having a leading edge or luff 16 secured to a furling stay cover 28 positioned about forestay 12, a rear hypotenuse edge called a leech 18 and a bottom or foot edge 20. The intersection of the three mentioned edges form corners called the head 22, at the top of the jib 14; a clew 24, at the intersection of the leech 18 and foot edge 20; and a tack 26 at the intersection of the luff 66 and foot edge 20.

The leading edge or luff 16 of jib 14 comprises a bead which is used in the hoisting and securing of jib 14 to forestay cover 28. The bead is formed by wrapping luff edge 16 around a rope or a wire and holding it firmly in place by means of a binding. The binding may be a piece of heavy material folded over the luff edge 16 and rope and stitched, or it can be other connecting means commonly used in the art.

Figure 2:
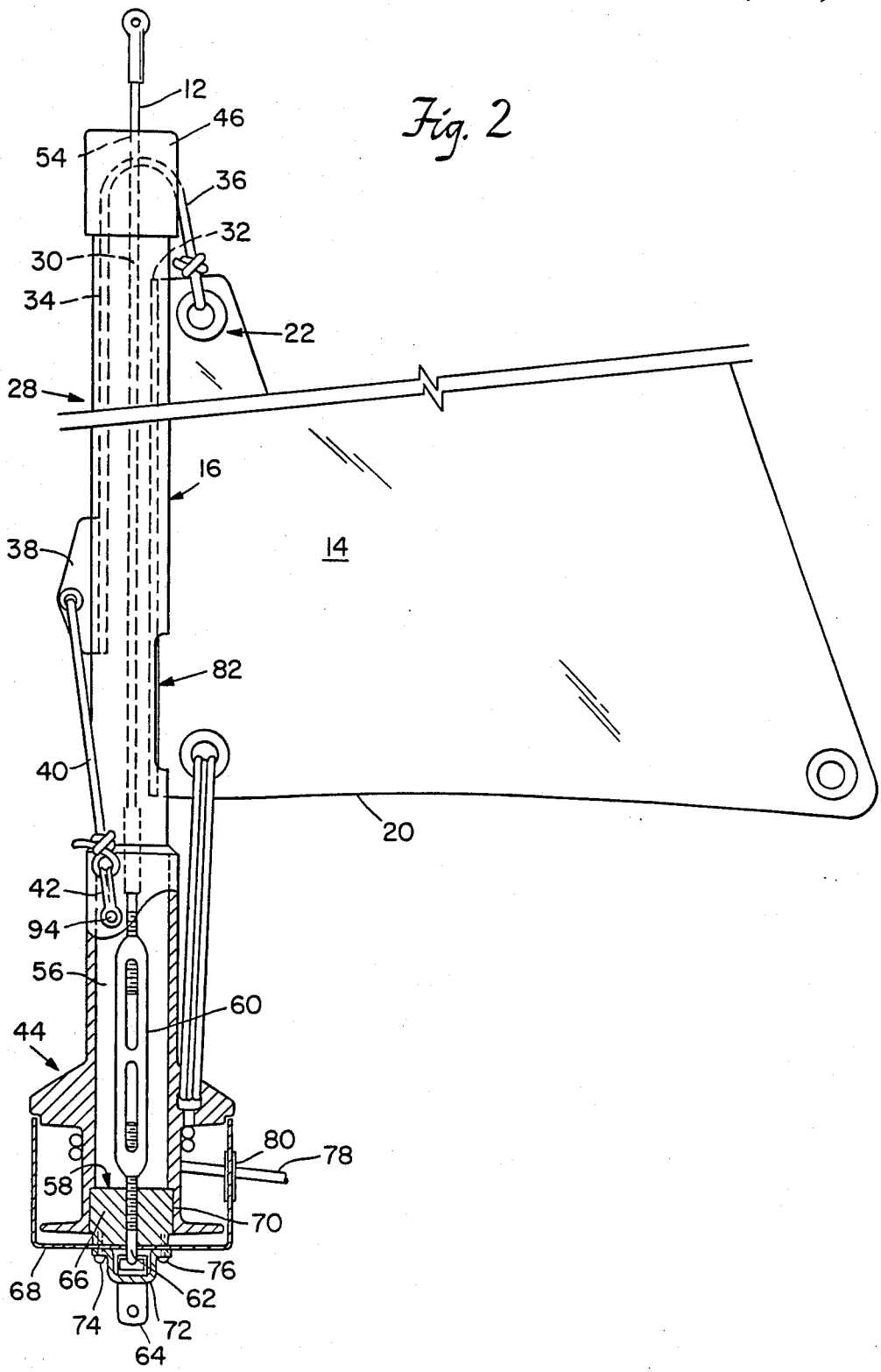
FIG. 2 is a schematic of a preferred embodiment of the present invention.

The furling stay cover 28 embodies the present invention and acts as a sleeve which fits over forestay 12. As shown in FIG. 2, sleeve or cover 28 has two grooves 32, 34 on opposite sides and a central tunnel 30 through which the forestay 12 is threaded. The longitudinal axes of tunnel 30 and grooves 32, 34 are parallel to the major axes of sleeve 28. One of the side grooves 32 receives and engagably retains the bead of the luff edge 16 of the staysail 14. A halyard 36 connected to the head 22 of staysail 14 travels over the top of the sleeve cover 28 and down through the second side groove 34. Within second side groove 34, the halyard 36 is pre-connected during manufacturing of the device to an eye or handle 38. The eye 38 slides within the second side groove 34 toward the bottom end of sleeve cover 28. Attached to eye 38, rope 40 is used to pull the eye 38 from the top of sleeve 28 downward in second side groove 34. The downward sliding of eye 38 causes halyard 36 to pull the bead of jib 14 up through the first side groove 32, thus hoisting the jib. Once jib 14 is hoisted, eye 38 is secured in place by the tying of rope 40 to a fixed loop or eye strap 42 on the outside of spool 44.

Figure 3A:
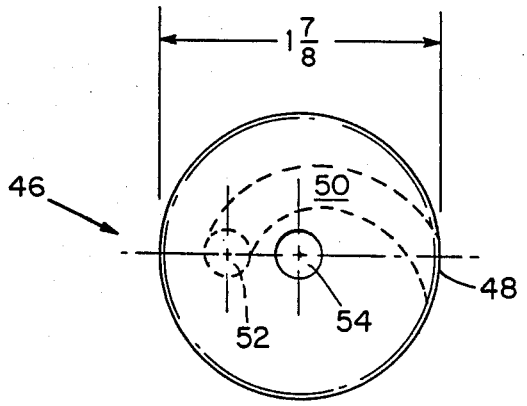
FIGS. 3*a* and 3*b* are a plan view and a longitudinal section respectively, of a cap of the embodiment of FIG. 2.
Figure 3B:
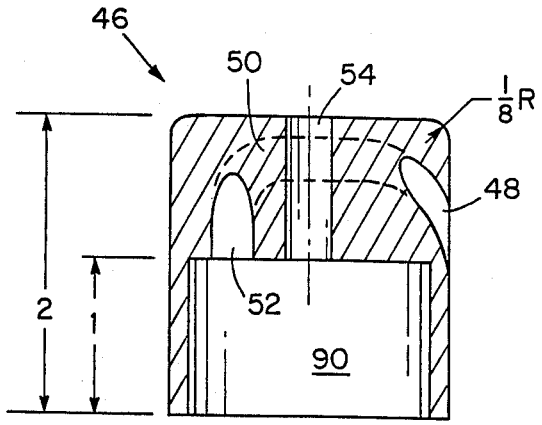

A cap 46 fits over the top end of sleeve cover 28, as shown in FIG. 2. Shown in more detail in FIGS. 3*a* and 3*b*, cap 46 has a bore 90 which matches the shape of the top end of sleeve 28 and receives the same. Cap 46 also has a side opening 48 on the staysail side of the sleeve and cap assembly to receive halyard 36. The side opening 48 is one end of a curved tunnel or pathway 50 through the cap which leads to a downward facing opening 52 into second side groove 34. Pathway 52 curves away from and around one side of forestay 12 which passes through a central slot 54 in cap 46 into tunnel 30 of cover 28.

A cap using conventional sheaves or a sheave may also be used.

As illustrated in FIG. 2, the bottom end of sleeve 28 is removeably fitted into a longitudinal slot of spool 44 through an opening in the top end of spool 44. The bottom edge of sleeve 28 rests on the inwardly extending part of pin 94 which secures eye strap 42 on the outside of spool 44. Forestay 12 continues from tunnel 30 of sleeve 28 through slot 56 of spool 44. A turnbuckle 60 is introduced into slot 56 through an opening 58 on the bottom end of spool 44. Forestay 12 is secured to the top end of turnbuckle 60 by conventional stud means. A T-bolt 62 is threaded to the bottom end of turnbuckle 60. A toggle strap seated over the cross bar of T-bolt 62 secures the turnbuckle-forestay assembly to a bow fixture, such as a stemhead fitting of the sailboat. Other methods for connecting the forestay 12 to a bow fixture are suitable. Alternatively, Forestay 12 may be connected to a non-rotating portion of spool 44 as will be discussed.

The bottom end opening 58 of slot 56 of spool 44 is shaped to receive and cover non-rotatable bearing 66. Hence, spool 44 sits on and rotates about bearing 66. The bottom of bearing 66 is secured to cup 68 which holds a lower portion of spool 44. A center hole 70 through bearing 66 and cup 68 provides T-bolt 62 access to toggle strap 64 on the outside of the bottom of cup 68.

Bearing 66 is secured to cup 68 by screws 74, 76 through a u-shaped bracket 72. Screws 74, 76 through legs of the u-shaped bracket 72 secure bearing 66 to the inside surface of the bottom of cup 68 and secure the u-shaped bracket 72 to the outside surface of the bottom of cup 68. In addition, the curved portion of u-shaped bracket 72 is positioned between the legs of the toggle strap 64 which is fixed to the sailboat. Secured in this manner, u-shaped bracket 72 prevents rotation of bearing 66 within cup 68 and prevents rotation of cup 68 about forestay 12.

A furling line 78 is wound around the lower portion of spool 44. The loose end of furling line 78 extends out of cup 68 through a hole or grommet 80 in one side of the cup.

To furl staysail 14, furling line 78 is pulled so as to unwind the line from spool 44 and to rotate the spool 44 and sleeve 28 about bearing 66. Because the sleeve 28 comprises a torsionally flexible material, the sleeve 28 will twist a small amount under the opposing rotating force applied by the furling spool 44 and the wind across the staysail 14. Thus, the upper end of the sleeve 28 spaced from the furling spool 44 will rotate slightly less than the lower end adjacent to the furling spool 44. Twisting of the sleeve 28 during furling causes the foot edge 20 of staysail 14 to be furled at a faster rate than that at which the head area of staysail 14 is furled. This may advantageously modify the aspect ratio of the staysail with furling.

Further, should the furling device become entangled in halyards other than halyard 36 connected to staysail 14, with the effect of jamming the upper end of sleeve 28, excessive force applied by furling spool 44 on sleeve 28 will cause the sleeve to longitudinally twist without exceeding its elastic limit. This allows sleeve 28 to survive undamaged the entanglement during furling, and prevents the entangled halyards from damaging forestay 12 either by severing the individual strands of the forestay, or by unlaying or birdcaging the forestay.

Sleeve 28 comprises a polymeric extruded thermoplastic with a shear modulus of about 50,000 to about 200,000 inch-pounds per radian and a tensile modulus of about $4\times10^5$ pounds/square inch to about $5\times10^5$ pounds/square inch. In the preferred embodiment, sleeve 28 comprises rigid PVC (polyvinyl chloride), however polycarbonate or a terpolymer of acrylonitrile, butadiene and styrene, or similar polymers are suitable. More generally, sleeve 28 comprises sufficiently flexible and elastic material which allows the sleeve to twist five to ten revolutions without reaching its elastic limit, yet is stiff enough to actually twist only one to two revolutions during furling in about 20 knot winds.

Applicant designs dimensions of the device and chooses material to withstand twice torque, T, defined by:

$$T=L\times R$$

where R is the rolling radius in inches which is the largest radius of sleeve 28 which rotates about the forestay. L is the sheet load in pounds defined by:

$$L=A\times V^2\times 0.0043$$

where A is the sail area in square feet; V is wind velocity in miles per hour; and 0.00431 is a conversion factor to pounds.

A further feature of the flexibility of the material of sleeve 28 is its ability to laterally bend along its length to at least a radius of less than about half its length. In addition, such bending increases the ease of disassembly where prior art devices required great care so as not to suffer permanent damage of a forestay device with the release of tension in the forestay to drop the mast, or required positioning of the stay and device on the outside of a pulpit rail and to the side of the boat. The present invention allows releasing of the forestay within cover 28 in its sailing position. Sleeve 28 conforms without permanent deformation to the catenary bending reaction of the released forestay. That is, when the forestay is released it assumes a catenary bend. Sleeve 28 is sufficiently elastic such that it does not permanently deform under such bending.

Hence, sleeve 28 is stiff enough to obtain the desired results in furling, yet flexible enough to bend during disassembly or twist during furling, and elastic enough to return to its natural shape. Further, the combination of flexibility and elasticity of sleeve 28 enables coiling of the sleeve or bending to a closed loop for ease in transportation and efficiency in storage.

Figure 4:
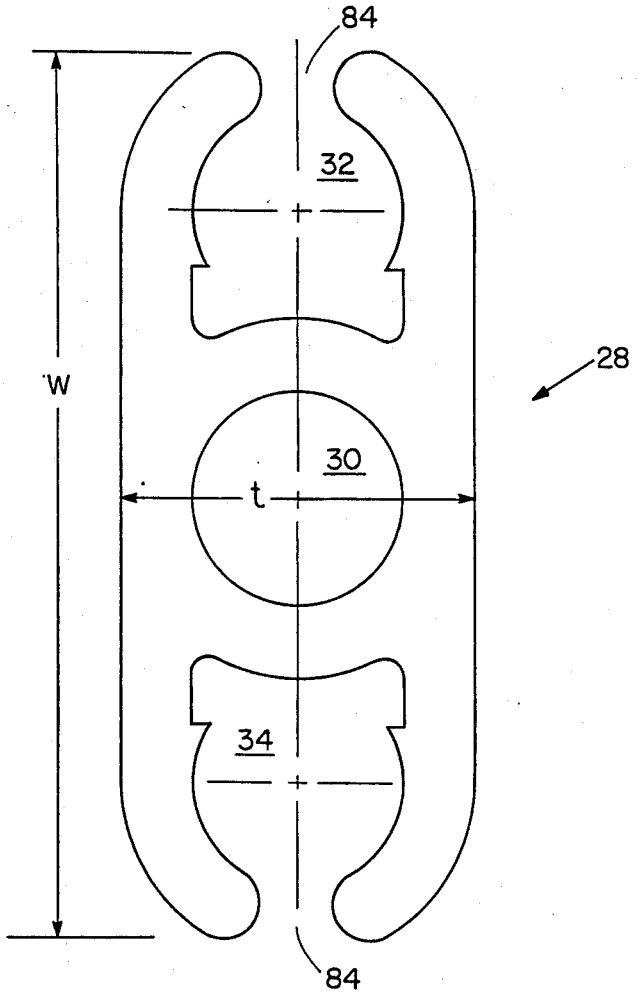
FIG. 4 is a cross-section of a sleeve of the embodiment of FIG. 2.

Although the shape of sleeve 28 is not critical to the present invention, FIG. 4 illustrates the cross-section of sleeve 28 in one of the smallest embodiments of the invention. The cross-section of sleeve 28 is generally ellipsoidal with a width, W, of about $1\frac{1}{2}$ inches and a thickness, t, of about $\frac{5}{8}$ inches. The rolling radius is thus about $\frac{3}{4}$ inch. The length of sleeve 28 is about twenty-one feet long, but may vary from sailboat to sailboat according to the length of the forestay. The diameter of tunnel 30 is at least twice the diameter of forestay 12. In turn, larger embodiments of the invention will have nearly circular cross-sections, as the side grooves stay the same size and the diameter of the forestay tunnel increases. Furthermore, prior art devices taught that close tolerance between the forestay and device was ideal. In the present invention, however, a loose tolerance provides advantages in assembly and disassembly of sleeve 28.

In addition, the shape and material of sleeve 28 provide a sleeve which is strong enough to withstand the forces involved in hoisting the jib using opposite side grooves 34 and 32 which are positioned fore and aft respectively.

Further, side grooves 32, 34 are generally symmetrical. The cross-section of each groove is generally circular in shape. A slit 84 in the top of the shape communicates with the outside and allows a staysail to flow out of that side groove of sleeve 28. Orientation of sleeve 28 during assembly is determined by feed slot 82 in one side groove of sleeve 28 as shown in FIG. 2. Staysail 14 is initially fed into the side groove through feed slot 82. The other side groove readily retains the halyard 36 and hoisting eye 38.

Figure 5A:
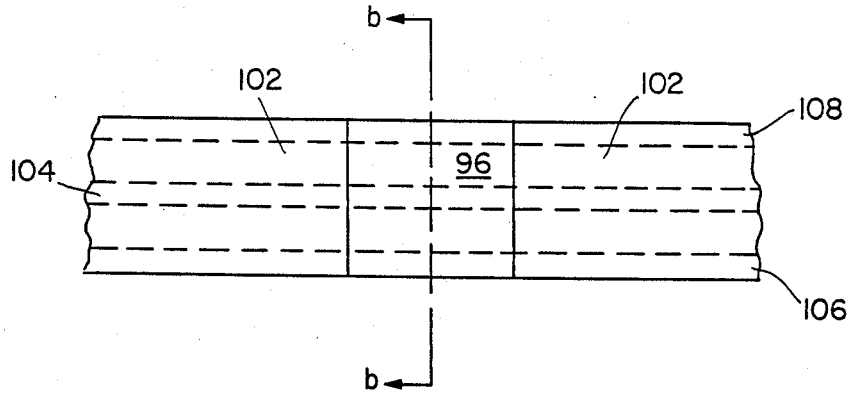
FIGS. 5*a* and 5*b* are a plan view and a cross-section, respectively of a joint of two sleeve pieces in another embodiment of the invention.
Figure 5B:
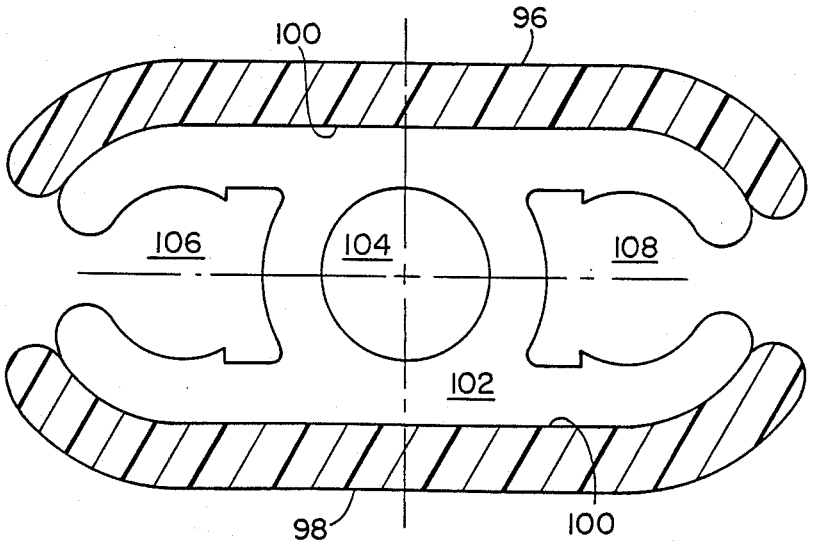

Although the foregoing describes sleeve 28 as a continuous one piece member, sleeve 28 may comprise several pieces along its length. In that case, sleeve 28 is cut along its length into about seven foot long pieces. The device is then more readily able to be shipped long distances. During the first use of the device, the user joins the sleeve pieces by metal or plastic internal splines manufactured about the forestay tunnel 30 area, or by external splines, or by other conventional means. In the preferred embodiment, adjacent sleeve pieces are joined by gluing two side plates 96 and 98 to opposite sides of the sleeve member as shown in FIGS. 5*a* and 5*b*. Each plate 96, 98 lies between side grooves 106 and 108 on a respective side of the sleeve pieces 102, and each plate 96, 98 bridges together respective adjacent sleeve pieces 102. Side plates 96 and 98 have inner surfaces 100 shaped to match the contour of the outer surfaces of the sleeve pieces 102. The length of each side plate is about 1.5 to about four times a local dimension of the sleeve piece 102, such as the width, W, of FIG. 4.

Side plates 96 and 98 comprise the same materials as the sleeve pieces 102. A solvent glue is preferrably used to produce a joint which is as least as strong as the respective joined parent sleeve pieces 102. Also, the produced joints are strong enough to withstand the bending and twisting of the whole sleeve member as previously described. On the other hand, the joints do not substantially impede the whole sleeve member from bending and twisting as previously described. Twists produced during furling of the staysail, are localized along the lengths of the sleeve pieces 102 and away from the joints. Further, the whole sleeve member is still able to bend to a radius of less than about half its length.

While the invention has been particularly shown and described with reference to a preferred embodiment thereof, it will be understood by those skilled in the art that various changes in form and details may be made therein without departing from the spirit and scope of the invention as defined by the appended claims. For example, a single groove or triple groove sleeve may be employed by the furling device. In the case of a triple groove sleeve, two parallel aft grooves engagably retain respective luff edges of two staysails such that one staysail may be hoisted and set before the other staysail, previously hoisted and set, is lowered.

I claim:

1. A furling stay cover comprising:

an elongated member having a first groove for carrying a luff edge of a staysail and an area for loosely retaining a stay; and swivel means connected to a bottom end of the elongated member for rotating said elongated member about the stay positioned within the retaining area so as to furl the staysail about the elongated member, the elongated member being sufficiently stiff to furl the staysail yet sufficiently flexible and elastic such that the swivel means rotates the bottom end relative to an opposite end of the elongated member at least one revolution to make a full twist, the elongated member twisting during furling at least five revolutions along its length without reaching its elastic limit and without damage.

2. A furling stay cover as claimed in claim 1 wherein said elongated member is sufficiently flexible such that it twists under forces normally encountered in furling.

3. A furling stay cover as claimed in claim 1 wherein said elongated member twists one to two revolutions during furling in about 20 knot winds.

4. A furling stay cover as claimed in claim 1 further comprising a second groove parallel to the first groove for employing hoisting means to hoist the staysail carried in the first groove.

5. A furling stay cover as claimed in claim 1 wherein the area for loosely retaining the stay has a cross sectional diameter of about two to three times that of the stay such that the stay is loosely centralized in a bushingless manner.

6. A furling stay cover as claimed in claim 1 further comprising a cap for the top end of the elongated member, the cap having a curved pathway along which the halyard moves, the pathway guiding the halyard from just outside the first groove, away from the area retaining the stay, and into the second groove.

7. A furling stay cover as claimed in claim 1 wherein said swivel means include:

a non-rotatable bearing to which one end of the stay is attached; and a u-shaped bracket having its legs fixed to the bearing and the u-shape portion surrounding a bow fixture secured to a boat, the u-shaped bracket preventing rotation of the bearing.

8. A furling stay cover as claimed in claim 1 wherein said elongated member comprises an extruded polymeric thermoplastic material.

9. A furling stay cover as claimed in claim 1 wherein the elongated member is bendable along its length, to a radius of less than about half its length.

10. A furling stay cover as claimed in claim 9 wherein said elongated member bends to form a closed loop.

11. A furling stay cover comprising:

an elongated member having a first groove for carrying a luff edge of a staysail and an area for loosely retaining a stay, the elongated member having a plurality of elongated pieces joined end to end in succession, each of two adjacent pieces joined together by a pair of plates, one plate bridging across two adjacent pieces on one side of the groove and the other plate bridging across the two adjacent pieces on an opposite side of the groove; and swivel means connected to a bottom end of the elongated member for rotating said elongated member about the stay positioned within the retaining area so as to furl the staysail about the elongated member, the elongated member being sufficiently stiff to furl the staysail yet sufficiently flexible and elastic such that when the bottom end is rotated relative to an opposite end the elongated member is able to twist at least five revolutions without reaching its elastic limit.

12. A furling stay cover comprising:

an elongated member having two grooves along opposite sides and a longitudinal tunnel for receiving a stay centrally positioned between the two grooves, one side groove adapted to engageably retain a luff edge of a staysail, the second side groove for receiving a leading end of a halyard having an opposite end attached to an upper end of the staysail, the tunnel and two side grooves having major axes parallel to the longitudinal axis of the elongated member, the elongated member being sufficiently flexible and elastic such that it is able to bend to a radius of less than about one half of its length;

the elongated member having a plurality of elongated pieces joined end to end in succession by pairs of plates, one plate of each pair bridging across respective adjacent pieces on a side of the elongated member between the two grooves and a second plate of each pair bridging across the respective adjacent pieces on an opposite side of the elongated member between the two grooves; and swivel means for rotating said elongated member about the stay positioned in the tunnel so as to furl the staysail, said swivel means connected to a lower end of the elongated member.

13. A furling stay cover comprising:

hoisting means adapted to slide in a groove;

an elongated member having two grooves along opposite sides and a longitudinal tunnel for receiving a stay centrally located between the two grooves, the cross section of said tunnel being a closed shape, one side groove adapted to receive and engageably retain a luff edge of a staysail, the other side groove for employing the hoisting means to hoist the staysail engaged in said one side groove, the tunnel and two opposite side grooves having major axes parallel to the longitudinal axis of the elongated member, the elongated member comprising a plurality of elongated pieces joined end to end in succession; and swivel means for rotating said elongated member about the stay positioned within the tunnel so as to furl the staysail, said swivel means connected to one end of the elongated member, one end of the stay secured to a stationary part of the swivel means, the elongated member being sufficiently flexible and elastic such than when the one end of the elongated member is rotated about the stay relative to an opposite end the elongated member is able to twist during the furling of the staysail without reaching its elastic limit and without damage.

14. A furling stay cover as claimed in claim 13 where adjacent pieces are joined together by pairs of plates, one plate of each pair bridging across respective adjacent pieces on a side of the elongated member between the two grooves and a second plate of each pair bridging across the respective adjacent pieces on an opposite side of the elongated member between the two grooves.

15. A furling stay cover comprising:

hoisting means adapted to slide in a groove;

an elongated member having two grooves along opposite sides and a longitudinal tunnel for receiving a stay centrally located between the two grooves, the cross section of said tunnel being a closed shape, one side groove adapted to receive and engageably retain a luff edge of a staysail, the other side groove for employing the hoisting means to hoist the staysail engaged in said one side groove, the tunnel and two opposite side grooves having major axes parallel to the longitudinal axis of the elongated member; and swivel means for rotating said elongated member about the stay positioned within the tunnel so as to furl the staysail, said swivel means connected to one end of the elongated member, one end of the stay secured to a stationary part of the swivel means, the elongated member being sufficiently flexible and elastic such that the swivel means rotates the one end of the elongated member relative to an opposite end of the elongated member at least one revolution to make a full twist during furling of the stay sail without reaching its elastic limit and without damage.

16. A furling stay cover as claimed in claim 15 wherein said elongated member is sufficiently stiff such that it twists only about one to two revolutions under forces normally encountered during furling in about 20 knot winds.

17. A furling stay cover as claimed in claim 15 wherein said elongated member comprises material having a tensile modulus of less than about 500,000 pounds/square inch and a shear modulus of less than about 200,000 inch-pounds/radian.

18. A stay cover as claimed in claim 15 further comprising a cap on the top end of the elongated member, the cap having a curved pathway along which the central region of the halyard moves, the pathway guiding the halyard from just outside the one side groove, partially around the tunnel, and into the other side groove.

19. A furling stay cover as claimed in claim 15 wherein said swivel means include:

a housing for a spool, said housing being attachable to a boat;

a bearing adapted to be non-rotatable within the housing, the one end of the stay secured to the bearing;

a spool having one end adapted to removeably receive and retain the one end of the elongated member, and an opposite end adapted to rotatably attach to said bearing; and a line wound about said spool such that pulling and winding of the cord causes the spool to rotate about the bearing and the elongated member to rotate about the stay.

20. A furling stay cover as claimed in claim 19 wherein said swivel means further includes a u-shaped bracket which prevents rotation of the bearing, the two legs of the bracket fixed to the bearing and the curved portion of the u-shaped surrounding a bow fixture of a boat.

21. A stay cover as claimed in claim 15 wherein said elongated member comprises an extruded polymeric thermoplastic material.

22. A furling stay cover as claimed in claim 15 wherein said elongated member is bendable to form a closed loop.

23. A furling stay cover as claimed in claim 15 wherein said elongated member is bendable along its length to a radius of less than half its length.

24. A furling stay cover as claimed in claim 15 wherein said tunnel has a cross-sectional diameter of at least twice that of the stay for loosely holding the stay.

25. Forestay apparatus comprising:

a forestay sleeve having a groove on one side; and a cap fitting on top of the sleeve and having:

a centrally positioned tunnel for receiving a forestay; and a curved pathway for guiding a halyard from a first opening in one side of the cap to a second opening in a lower portion of the cap positioned over the groove of the sleeve such that the halyard enters into the groove upon passing through the second opening, the pathway being free of pulleys and curving around the forestay tunnel.

26. Forestay apparatus as claimed in claim 25 wherein said first opening holds an end of the halyard which is connected to a staysail and the second opening introduces an opposite end of the halyard to hoisting means in the groove.

27. A method of furling comprising the steps of:

providing a furler having an elongated member with a groove which engageably retains a luff edge of a staysail, the elongated member being sufficiently flexible and elastic such that one end is able to be rotated relative to an opposite end at least one revolution to make a full twist without the elongated member reaching its elastic limit;

rotating said elongated member from a bottom end such that at least one twist is made along the length of the elongated member, and a lower end of the staysail is furled at a greater rate than an upper end.

28. A method of furling as claimed in claim 27 wherein the elongated member comprises a single jointless piece.

29. A method as claimed in claim 27 wherein the step of providing a furler includes threading a stay through a longitudinal tunnel in the elongated member, the tunnel having a cross-sectional diameter of about two to three times that of the stay such that the stay is centralized in a bushingless manner and loosely retained within the furler.

30. A furling stay cover comprising:

an elongated member having two grooves along opposite sides and a longitudinal tunnel for receiving a stay centrally positioned between the two grooves, one side groove adapted to engageably retain a luff edge of a staysail, the second side groove for receiving a leading end of a halyard having an opposite end attached to an upper end of the staysail, the tunnel and two sides grooves having major axes parallel to the longitudinal axis of the elongated member, the elongated member being sufficiently flexible and elastic such that it bends at user will to a radius of less than about one half its length without damage and twists at least one revolution along its length during furling without damage; and swivel means for rotating said elongated member about the stay positioned in the tunnel so as to furl the staysail, said swivel means connected to a lower end of the elongated member and rotating the lower end relative to an opposite end of the elongated member at least one revolution to make a full twist during furling without the elongated member reaching its elastic limit.

31. A furling stay cover as claimed in claim 30 wherein the longitudinal tunnel has a cross-sectional diameter of about two to three times that of the stay such that the stay is loosely centralized in a bushingless manner within the elongated member.

32. A furling stay cover as claimed in claim 30 further comprising a cap for the upper end of the elongated member, the cap having a curved pathway for guiding the halyard from the upper end of the staysail into the second side groove without intersecting the tunnel for the stay.

33. A furling stay cover as claimed in claim 30 wherein said swivel means include:

a bearing to which a bottom end of the stay is attached, the bearing adapted to be non-rotatable; and a u-shaped bracket having its leg secured to the bearing and the curved portion linked to a bow fixture secured to a boat, the bow fixture preventing rotational movement of the u-shaped bracket and the u-shaped bracket thereby preventing rotation of the bearing.

34. A furling stay cover as claimed in claim 33 wherein the curved portion of the U-shaped bracket passes between legs of a toggle strap secured to the bow of the boat.

35. A furling stay cover as claimed in claim 30 wherein the elongated member comprises an extruded polymeric thermoplastic having a tensile modulus of elasticity of between about $4\times10^5$ and $5\times10^5$ pounds/-square inch and a shear modulus between about 50,000 and 200,000 inch pounds/radian.

36. A furling stay cover as claimed in claim 30 wherein said elongated member is able to bend to form a closed loop.

37. A furling stay cover comprising:

an elongated member having a first groove for carrying a luff edge of a staysail and an area for loosely retaining a stay; and swivel means connected to a bottom end of the elongated member for rotating said elongated member about the stay positioned within the retaining area so as to furl the staysail about the elongated member, the elongated member being sufficiently stiff to furl the staysail yet sufficiently flexible and elastic such that the swivel means rotates the bottom end relative to an opposite end of the elongated member at least one revolution to make a full twist, the elongated member twisting at least five revolutions without reaching its elastic limit during furling; the swivel means including:

a bearing to which the bottom end of the stay is attached; and a u-shaped bracket having its legs fixed to the bearing and the u-shape portion fitting between legs of a toggle strap pinned to a deck portion at a bow of a boat, such that the u-shaped bracket is prevented from rotating and thereby prevents rotation of the bearing.

38. A furling stay cover comprising:

an elongated member having two grooves along opposite sides and a longitudinal tunnel for receiving a stay centrally positioned between the two grooves, one side groove adapted to engagably retain a luff edge of a staysail, the second side groove for receiving a leading end of a halyard having an opposite end attached to an upper end of the staysail, the tunnel and two side grooves having major axes parallel to the longitudinal axis of the elongated member, the elongated member being sufficiently flexible and elastic such that it is able to bend to a radius of less than about one-half its length without damage, the elongated member comprising a plurality of elongated pieces joined to end in succession; and swivel for rotating said elongated member about the stay positioned in the tunnel so as to furl the staysail, said swivel means connected to a lower end of the elongated member.

39. A furling stay cover comprising:

an elongated member having a first groove for carrying a luff edge of a staysail and an area for loosely retaining a stay, the elongated member comprising a single jointless piece; and swivel means connected to a bottom end of the elongated member for rotating said elongated member about the stay positioned within the retaining area so as to furl the staysail about the elongated member, the elongated member being sufficiently stiff to furl the staysail yet sufficiently flexible and elastic such that when the bottom end is rotated relative to an opposite end the elongated member is able to twist at least five revolutions along its length without reaching its elastic limit and without damage.

40. A furling stay cover comprising:

hoisting means adapted to slide in a groove;

an elongated member having two grooves along opposite sides and a longitudinal tunnel for receiving a stay centrally located between the two grooves, the cross section of said tunnel being a closed shape, one side groove adapted to receive and engageably retain a luff edge of a staysail, the other side groove for employing the hoisting means to hoist the staysail engaged in said one side groove, the tunnel and two opposite side grooves having major axes parallel to the longitudinal axis of the elongated member, the elongated member comprising a single jointless piece; and swivel means for rotating said elongated member about the stay positioned within the tunnel so as to furl the staysail, said swivel means connected to one end of the elongated member, one end of the stay secured to a stationary part of the swivel means, the elongated member being sufficiently flexible and elastic such that when the one end of the elongated member is rotated about the stay relative to an opposite end the elongated member is able to twist during furling of the staysail without reaching its elastic limit and without damage.

41. A furling stay cover comprising:

an elongated member having a first groove for carrying a luff edge of a staysail and an area for loosely retaining a stay, the elongated member comprising a plurality of elongated pieces joined end to end in succession; and swivel means connected to a bottom end of the elongated member for rotating said elongated member about the stay positioned within the retaining area so as to furl the staysail about the elongated member, the elongated member being sufficiently stiff to furl the staysail yet sufficiently flexible and elastic such that when the bottom end is rotated relative to an opposite end the elongated member is able to twist at least five revolutions along its length without reaching its elastic limit and without damage.

42. A furling stay cover comprising:

an elongated member having two grooves along opposite sides and a longitudinal tunnel for receiving a stay centrally positioned between the two grooves, one side groove adapted to engagably retain a luff edge of a staysail, the second side groove for receiving a leading end of a halyard having an opposite end attached to an upper end of the staysail, the tunnel and two side grooves having major axes parallel to the longitudinal axis of the elongated member, the elongated member being sufficiently flexible and elastic such that it is able to bend to a radius of less than about one half its length without damage, the elongated member comprising a single jointless piece; and swivel means for rotating said elongated member about the stay positioned in the tunnel so as to furl the staysail, said swivel means connected to a lower end of the elongated member.

* * * * *